US010111801B2

(12) United States Patent
Liberatoscioli

(10) Patent No.: US 10,111,801 B2
(45) Date of Patent: Oct. 30, 2018

(54) APPARATUS FOR RELIEVING BACK PAIN

(71) Applicant: Dante Liberatoscioli, Malvern, PA (US)

(72) Inventor: Dante Liberatoscioli, Malvern, PA (US)

( * ) Notice: Subject to any disclaimer, the term of this patent is extended or adjusted under 35 U.S.C. 154(b) by 384 days.

(21) Appl. No.: 14/772,420

(22) PCT Filed: Mar. 5, 2014

(86) PCT No.: PCT/US2014/020749
§ 371 (c)(1),
(2) Date: Sep. 3, 2015

(87) PCT Pub. No.: WO2014/138235
PCT Pub. Date: Sep. 12, 2014

(65) Prior Publication Data

US 2016/0000634 A1 Jan. 7, 2016

Related U.S. Application Data

(60) Provisional application No. 61/851,303, filed on Mar. 5, 2013.

(51) Int. Cl.
*A61H 1/02* (2006.01)

(52) U.S. Cl.
CPC ... *A61H 1/0229* (2013.01); *A61H 2201/0157* (2013.01); *A61H 2201/0161* (2013.01);
(Continued)

(58) Field of Classification Search
CPC ..... A61H 1/0229; A61H 2201/0157; A61H 2201/0161; A61H 2201/0207;
(Continued)

(56) References Cited

U.S. PATENT DOCUMENTS 3,960,145 A 6/1976 Scarbrough
3,966,200 A 6/1976 Kirk
(Continued)

OTHER PUBLICATIONS

PCT International Search Report and Written Opinion for PCT/US2014/020749, dated Jun. 13, 2014.

*Primary Examiner* — Ophelia A Hawthorne
(74) *Attorney, Agent, or Firm* — Joseph E. Maenner; Maenner & Associates, LLC

(57) ABSTRACT

An apparatus for performing spinal decompression has a slanted surface coupled with opposing arm supports for receiving a user, or a grab bar, for suspending the user on the slanted surface under the influence of gravity, responsive to the user's weight. The amount of spinal decompression accomplished can be adjusted by varying the angle of the slanted surface, preferably by providing opposing ends of the table with legs, at least some of which are adjustable. The opposing arm supports and the grab bar are preferably adjustably associated with the slanted surface, for maximizing the user's comfort and for accommodating users of different sizes, and can be padded for added comfort and convenience. The apparatus can be made portable, for storage or transport. The apparatus can be provided with one or more heating pads to apply heat to the upper body, the lower back or the arms of the user.

16 Claims, 5 Drawing Sheets

(52) U.S. Cl.
CPC ..... *A61H 2201/0207* (2013.01); *A61H 2201/1614* (2013.01); *A61H 2201/1635* (2013.01); *A61H 2203/0456* (2013.01); *A61H 2205/06* (2013.01); *A61H 2205/081* (2013.01)

(58) Field of Classification Search
CPC .... A61H 2201/1614; A61H 2201/1635; A61H 2203/0456; A61H 2205/06; A61H 2205/081
See application file for complete search history.

(56) References Cited

U.S. PATENT DOCUMENTS

| | | | | | |
|---|---|---|---|---|---|
| 4,102,336 | A * | 7/1978 | Wiener | A61H 1/0218 | 606/241 |
| 4,815,732 | A | 3/1989 | Mahvi | | |
| 4,867,143 | A * | 9/1989 | Morin | A61H 1/0218 | 482/144 |
| 4,915,101 | A | 4/1990 | Cuccia | | |
| 5,718,722 | A * | 2/1998 | Kiefer | A61H 1/0292 | 219/217 |
| 5,774,916 | A | 7/1998 | Kurhi | | |
| 6,468,192 | B1 | 10/2002 | Doerscheln | | |
| 7,361,128 | B2 * | 4/2008 | Chen | A61H 1/0218 | 482/142 |
| 2005/0187084 | A1 * | 8/2005 | Tornabene | A63B 21/068 | 482/140 |
| 2006/0035764 | A1 | 2/2006 | Webber | | |
| 2012/0277076 | A1 * | 11/2012 | Huang | A61H 23/0263 | 482/142 |

* cited by examiner

FIG. 3
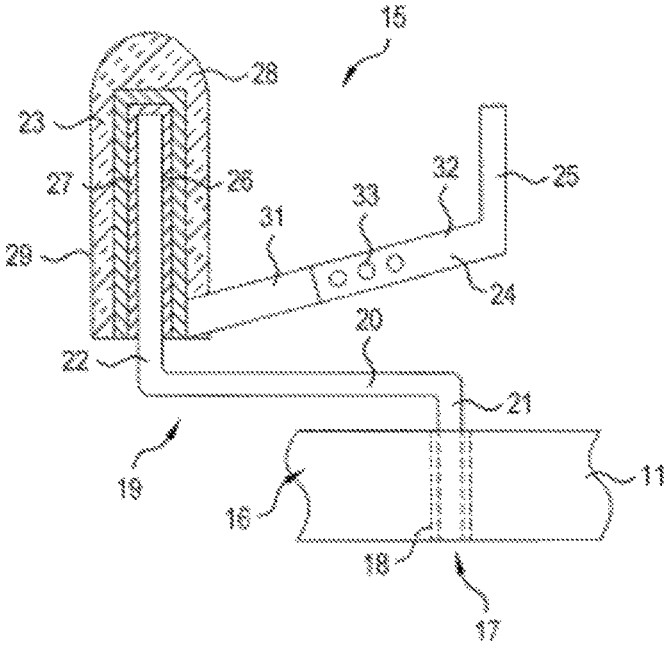
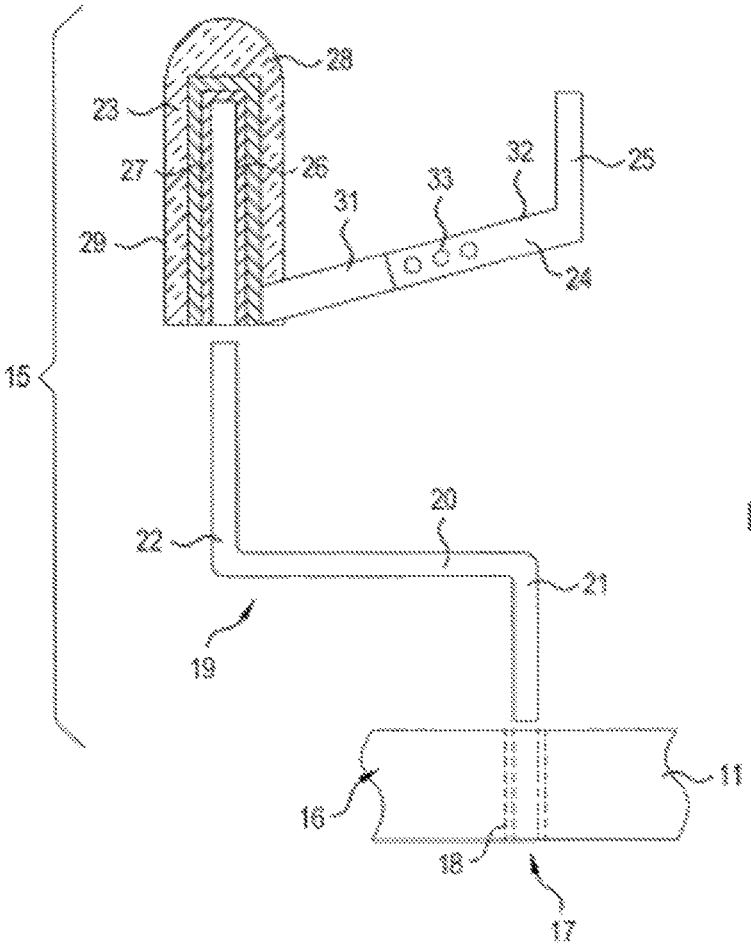
FIG. 4

APPARATUS FOR RELIEVING BACK PAIN

RELATED CASE

This patent application is a U.S. National Stage Patent Application of Patent Cooperation Treaty Patent Application PCT/US2014/020749, filed Mar. 15, 2014, which claims the benefit of U.S. Provisional Application No. 61/851,303, filed Mar. 5, 2013, the subject matter of both of which are incorporated by reference as if fully set forth herein.

BACKGROUND OF THE INVENTION

The present invention generally relates to an apparatus used for the relief of back pain, primarily utilizing gravity to achieve spinal decompression.

Lower back pain is widely and commonly experienced by a large segment of the population, including men and women working in any of a variety of different endeavors and occupations. A common treatment for back pain involves periodic treatment by a chiropractor. However, while such treatment can provide relief from many forms of back pain, it is not uncommon for the pain to return following treatment. Another alternative is treatment by an orthopedic physician. However, the pain can return following orthopedic treatment, as well. Moreover, chiropractic treatment and orthopedic treatment can both be prohibitively costly.

Various devices have been developed for the treatment of back pain, which can be used either alone or to supplement professional treatment to provide additional relief.

Devices have been developed which generally operate to treat back pain by inverting a user. Such devices, however, can be quite harsh, and can lead to potentially adverse consequences such as hemorrhaging, particularly when used by those taking blood thinning medications, the exacerbation of acid reflux, and damage to the leg or hip joints.

Other devices have been developed which generally require the user to lie on the floor. Such devices, however, exhibit the potential disadvantage of requiring the user to assume a position on the floor and to later get up from the floor, which can be extremely difficult and painful to accomplish, particularly for those experiencing severe pain. Consequently, such approaches are generally not recommended.

A further consideration is that many of the devices which have been developed for the treatment of back pain require the user to employ straps, trusses or other similar components to effectively interact with the device. Such components, however, can be extremely cumbersome, uncomfortable and difficult to use, particularly for users experiencing severe pain.

Consequently, it remained desirable to develop an apparatus which could be safely and conveniently used for the home treatment of back pain, without the costly intervention of an orthopedic physician or a chiropractor.

SUMMARY OF THE INVENTION

These and other advantages are achieved in accordance with the present invention by providing an apparatus capable of gently and conveniently performing spinal decompression.

In a preferred embodiment, such an apparatus can be implemented by providing a slanted surface having opposing arm supports for receiving a user in a manner that gently suspends the user from under the arms and under the influence of gravity, responsive to the user's weight. A grab bar can also be provided for use, either alone or in conjunction with the opposing arm supports. The amount of force applied, and the resulting spinal decompression accomplished, can be adjusted by varying the angle of the slanted surface. This is preferably accomplished by providing opposing ends of the table with legs, at least some of which are adjustable, so the elevation of the opposing ends of the table can be varied, as desired.

The opposing arm supports for receiving the user are preferably adjustably associated with the slanted surface, for maximizing the comfort of the user and for accommodating users of different sizes. To this end, a compound pivot is preferably provided, having one portion which is pivotally coupled with the slanted surface and another portion which is pivotally coupled with an arm support. The arm support is preferably padded for added comfort and convenience. The grab bar is also preferably adjustably associated with the slanted surface to maximize the user's comfort and to accommodate users of different sizes.

In this way, an affordable apparatus is provided for the relief of back pain by way of spinal decompression. Such an apparatus is well suited to home use, and is simple to operate, providing convenient access by a user. The apparatus is easy to mount and dismount, requires no straps or trusses of any sort, and can easily control the amount of force applied while using the apparatus. Moreover, the apparatus is easy to set up, take down and store, and can easily fold for storage or transport. The apparatus can additionally be used with one or more heating pads, if desired, which can be coupled with different portions of the apparatus for applying heat to the upper body, the lower back or the arms of the user.

Such an apparatus can operate to apply decompressive forces to the user's spine, to help reduce episodic or chronic back pain, similar to other forms of spinal decompression, and this can be performed in a convenient and safe manner appropriate for home use. This is accomplished by adjustably supporting the upper body of the user while gently stretching the user's lower back responsive to the force of gravity.

BRIEF DESCRIPTION OF THE DRAWINGS

FIG. 3 is a partially sectioned, side elevational view showing an arm support for the apparatus.

FIG. 4 is a partially exploded, side elevational view of the arm support shown in FIG. 3.

DETAILED DESCRIPTION OF PREFERRED EMBODIMENTS

Figure 1:
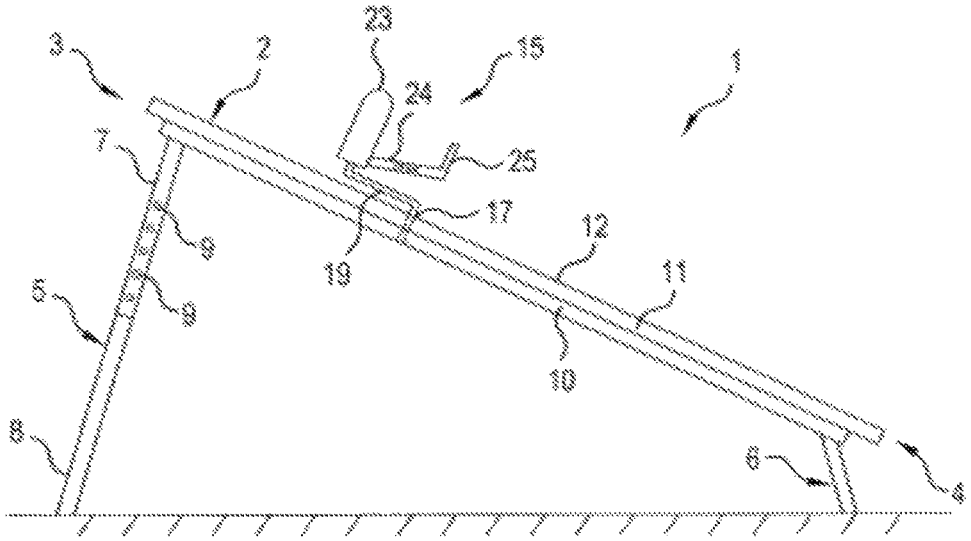
FIG. 1 is a side elevational view of an embodiment of an apparatus produced in accordance with the present invention.

An apparatus 1 for performing spinal decompression in accordance with the present invention generally includes a platform 2, the opposing ends 3, 4 of which are provided with supports 5, 6. For purposes of performing spinal decompression in accordance with the present invention, the platform 2 is slanted so a user can be received in a manner that will gently stretch the user's lower back responsive to the force of gravity.

To this end, the supports 5 associated with the end 3 of the platform 2 are longer than the supports 6 associated with the end 4 of the platform 2, to place the platform 2 at a desired incline. The incline of the platform 2 is preferably made adjustable so the applied forces can be varied.

For example, the supports 5 can be produced using a pair of elongate members 7, 8, each of which has a series of apertures 9 for receiving appropriate hardware for suitably joining the members 7, 8, for example, using wing nuts, bolts or threaded components. Variation of the apertures 9 used to join the members 7, 8 can then operate to adjust the lengths of the supports 5, and as a consequence, the elevation of the end 3 of the platform 2. As an alternative, and referring to FIG. 7, supports 5' can be produced from a pair of telescoping members 7', 8', one of which has a series of apertures 9 for accepting appropriate hardware for suitably engaging the other, for example, using a spring-biased detent arrangement. The lengths of the supports 5, 5', and as a consequence, the elevation of the end 3 of the platform 2, can in this way be adjusted by variation of the engaged apertures 9.

For simplification and for ease of manufacture, the supports 6 associated with the end 4 of the platform 2 need not be adjustable in length. Adjustment of the lengths of the supports 5, 5' is presently considered to be sufficient for most applications. As an alternative, the supports 6 associated with the end 4 of the platform 2 can be made adjustable in length, if desired, using structures similar to those associated with the supports 5, or other adjustable structures.

The platform 2 preferably includes a frame 10 combined with a supporting surface 11 attached to and extending over the frame 10. The use of a frame 10 and supporting surface 11 is presently considered preferred to provide the apparatus 1 with enhanced structural integrity. As an alternative, the platform 2 can be produced using only the supporting surface 11 provided the supporting surface 11 is formed of a material having sufficient structural integrity to safely and effectively support the user.

The supporting surface 11 is preferably provided with a covering 12 for enhancing the comfort of the user and the overall appearance of the apparatus, which can be a fabric, synthetic or natural hide covering. Padding is preferably associated with the supporting surface 11, and the covering 12, if used, to further enhance user comfort.

A heating element can further be combined with the supporting surface 11, and the covering 12, if used, to facilitate the application of heat to the user's back. Single or multiple heating units can be provided, if desired, which can be coupled with different portions of the apparatus 1 so heat can be applied to the user's upper body and/or lower back.

Figure 2:
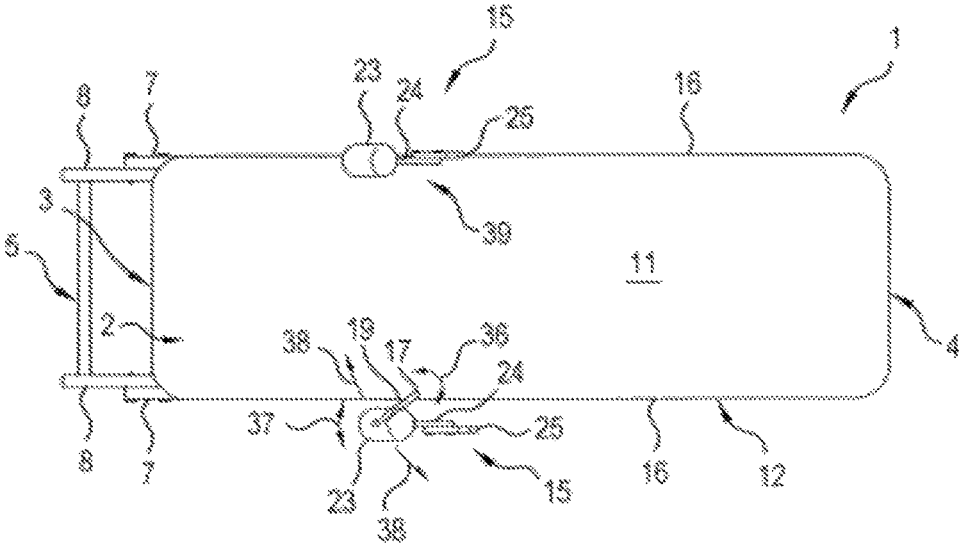
FIG. 2 is a top plan view of the apparatus shown in FIG. 1.

In the embodiment of the apparatus 1 shown in FIGS. 1 and 2, the supports 5, 6 are fixed to the opposing ends 3, 4 of the apparatus 1, respectively. This could be used for permanent installation of the apparatus 1. In other applications, where portability is desired, the supports 5, 6 can be made foldable by pivotally coupling the supports 5, 6 with the ends 3, 4 of the apparatus 1, respectively, or can be made removable by detachably coupling the supports 5, 6 with the ends 3, 4 of the apparatus 1, respectively.

Figure 5:
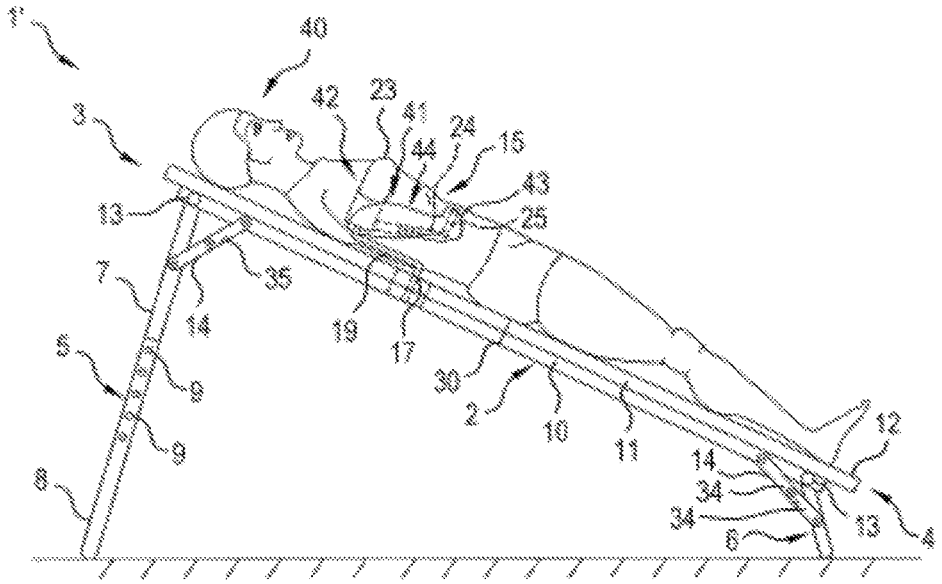
FIG. 5 is a side elevational view showing a user positioned on an alternative embodiment of an apparatus produced in accordance with the present invention.
Figure 6:
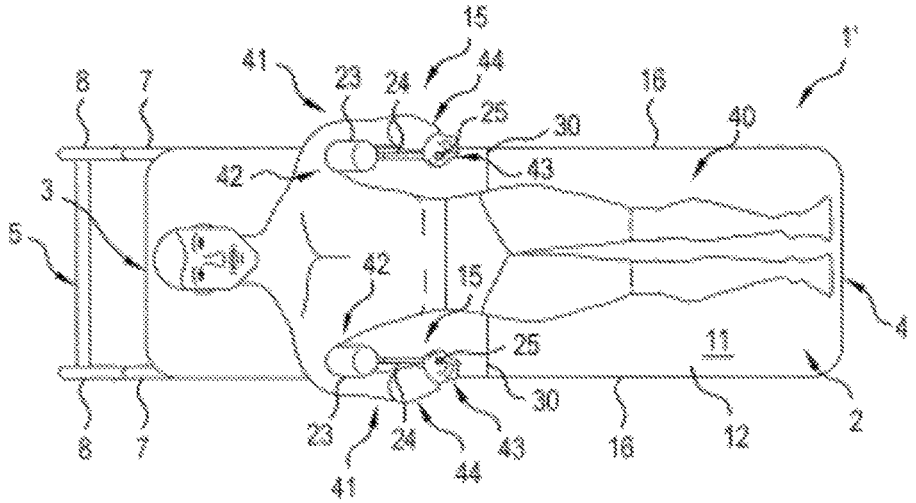
FIG. 6 is a top plan view of a user positioned on the apparatus shown in FIG. 5.

In the embodiment of the apparatus 1' shown in FIGS. 5 and 6, the supports 5, 6 are pivotally coupled with the opposing ends 3, 4 of the apparatus 1' at the pivots 13 and locking struts 14 extend between the platform 2 and the members 7 of the supports 5, as well as the platform 2 and the supports 6. The pivots 13 and struts 14 can be coupled with the frame 10, if used, or connected to the underside of the supporting surface 11 using appropriate hardware. As a further alternative, and to further enhance portability of the apparatus 1', the platform 2 can be segmented, for example, by separating the platform 2 at 30, as shown in FIGS. 5 and 6. The segmented portions of the platform 2 can then be connected by a hinged assembly, or the segmented portions can be provided with engageable structures for assembling and disassembling the platform 2, when desired.

An opposing pair of supports 15 are associated with opposite sides 16 of the platform 2 and are preferably positioned to receive the user's arms and for alignment with the user's arm pits. The platform 2 is provided with corresponding apertures 17 for receiving the supports 15 as will be described more fully below. For most applications, a single pair of supports 15 placed in fixed apertures 17 should be sufficient. Variable placement of the supports 15 is also possible, for purposes of adjusting the positioning of the supports 15 relative to the user's body. For example, plural apertures 17 can be provided along the opposing sides 16 of the platform 2, for removably receiving the supports 15 in different apertures 17, or plural supports 15 can be coupled with fixed apertures 17 formed in the sides 16 of the platform 2. The apertures 17 can be formed directly in the platform 2, or the platform 2 can be provided with bearings 18 for receiving the supports 15, if desired.

FIGS. 3 and 4 show a preferred embodiment for the supports 15. In this configuration, brackets 19 are used to couple the supports 15 with the apertures 17 of the platform 2. Each of the brackets 19 includes an arm 20, one end of which has a downwardly depending rod 21 for pivotally engaging one of the apertures 17 associated with the platform 2, and the other end of which has an upwardly directed rod 22 for engaging the associated support 15. In the embodiment shown in FIGS. 3 and 4, the rods 21, 22 are substantially normal to the arm 20. This is currently considered preferred to position the supports 15 substantially normal to the platform, which is expected to provide the user with maximum comfort. As an alternative, the angle developed between the rods 21, 22 and the arm 20 can be varied to suit a particular application, if desired. The angle formed between the rods 21, 22 and the arm 20 can also be made adjustable, if appropriate for a particular application, for example, using splined couplings suitably connected by threaded fasteners.

The supports 15 include a body 23 for engaging the rod 22 of the bracket 19, an arm rest 24 attached to and extending from the body 23, and a hand grip 25 coupled with and extending from the arm rest 24.

The body 23 includes a recess 26 for engaging the rod 22. The body 23 is preferably removably received on the rod 22, for convenient use and servicing. The recess 26 can be formed directly in the body 23, or the body 23 can be provided with a bearing 27 for receiving the rod 22, if desired. The body 23 is preferably padded to further enhance user comfort. For example, a foam cushion 28 can be placed over the body 23 to provide the desired padding. A cover 29 can be placed over the foam cushion 28, to enhance the comfort of the user and the overall appearance of the apparatus, and can be formed of a fabric, synthetic or natural hide material. Heating elements can also be combined with the body 23, the foam cushion 28 and the cover 29, if used, the arm rest 24 and the hand grip 25, for the application of heat to the user's arms and hands.

The arm rest 24 is preferably coupled with lower portions of the body 23, to facilitate placement of the user's arm over the arm rest 24. Placement of the arm rest 24 at an angle which is inclined from the body 23 to the hand grip 25 is presently considered preferred, for the user's comfort, although horizontal placement of the arm rest 24, placement of the arm rest 24 at another location along the body 23, or placement of the arm rest 24 at an angle which is different from the angle shown in FIGS. 3 and 4, can also be implemented to facilitate use of the apparatus and the comfort and convenience of the user. Vertical placement of the hand grip 25 is presently considered preferred, although placement of the hand grip 25 at an angle which is different from the vertical placement shown in FIGS. 3 and 4 can also be provided to facilitate use of the apparatus and the comfort and convenience of the user.

The angle formed between the arm rest 24 and the body 23 and the angle formed between the arm rest 24 and the hand grip 25 can be made adjustable, if appropriate for a particular application, for example, using splined couplings suitably connected by threaded fasteners. The length of the arm rest 24 is also preferably made adjustable, for the comfort and convenience of the user. For example, the arm rest 24 can be produced using a pair of elongate members 31, 32, each of which has a series of apertures 33 for receiving appropriate hardware for suitably joining the members 31, 32, for example, using wing nuts, bolts or threaded components. The length of the arm rest 24 can then be adjusted by variation of the aperture 33 used to join the members 31, 32. As an alternative, the arm rest 24 can be produced using a pair of telescoping members 31, 32, one having a series of apertures 33 for accepting appropriate hardware for suitably engaging the other, for example, using a spring-biased detent arrangement. For simplification and for ease of manufacture, the arm rest 24 need not be made adjustable in length, if preferred for a particular application.

The platform 2, the supports 5 (or 5'), 6 and the struts 14, as well as the brackets 19, bodies 23, arm rests 24 and hand grips 25 of the supports 15, can be formed of any of a variety of convenient materials, including metals, woods, plastics, fiberglass, carbon fiber and various composites. The various components of the apparatus can be formed of similar types of materials or different types of materials, as desired, to provide the apparatus with an appropriate weight-bearing capacity, a sufficient strength or structural integrity for a particular application, or a desired appearance.

Use of the apparatus will now be described. For portable embodiments, the apparatus must first be deployed. To deploy embodiments of the apparatus having a segmented platform 2, hinged segmented portions can be unfolded and engageable structures for joining separable segmented portions can be assembled, as is appropriate for a particular embodiment of the apparatus. To deploy embodiments of the apparatus having foldable legs, the supports 5, 6 can be raised from a stored position to an opened position by rotating the supports 5, 6 about the pivots 13. Raising the supports 5, 6 also preferably causes the struts 14 to open so that, upon full deployment of the supports 5, 6, the struts 14 will automatically be locked in position to secure the supports 5, 6 in desired position. For example, this can be accomplished with segmented struts 34 which are pivotally connected between the platform 2 and the supports 5, 6, and to each other, preferably in combination with a locking detent 35 for maintaining the segmented struts 34 in the deployed position. As an alternative, unitary struts pivotally connected to the platform 2 or to the supports 5, 6 can be secured to the opposing structure using appropriate hardware for interconnecting such structures. For fixed embodiments of the apparatus, having a unitary platform 2 and fixed supports 5, 6, the apparatus will already be deployed to this point.

The elevation and the incline of the apparatus can then be adjusted to suitably accommodate the user. To this end, the lengths of the supports 5 (or 5') at the end 3 of the platform 2 can be adjusted, preferably to equal lengths, by selection of the apertures 9 used to join the elongate members 7, 8 as previously described. For embodiments of the apparatus having adjustable supports 6, the lengths of the supports 6 can similarly be varied to establish the elevation of the opposing end 4 of the platform 2.

The supports 15 are coupled with the platform 2 by mating the rods 21 of the brackets 19 with the apertures 17 associated with the sides 16 of the platform 2 and by mating the rods 22 of the brackets 19 with the recesses 26 of the bodies 23, permitting compound rotational movement of the supports 15 in the direction of the arrows 36, 37, 38 shown in FIG. 2. A spring-loaded, mating engagement between the rods 21 of the brackets 19 and the apertures 17 of the platform 2 and the rods 22 of the brackets 19 and the recesses 26 of the bodies 23 is currently considered to be preferred to cause the supports 15 to assume the position shown at 39 in FIGS. 2 and 6, to place the supports 15 in a position which is convenient for the user when mounting and dismounting the platform 2. For embodiments of the apparatus having adjustable arm rests 24, the lengths of the arm rests 24 can be adjusted to accommodate the user, preferably to equal lengths, by selection of the apertures 33 used to join the elongate members 31, 32 as previously described. For embodiments of the apparatus which provide for adjustment of the angle formed between the arm rest 24 and the body 23, or for adjustment of the angle formed between the arm rest 24 and the hand grip 25, such adjustments can be made, for example, using the splined couplings previously described.

A user 40 can then mount the platform 2 by straddling the platform 2 near the midpoint, for example, adjacent to the line 30 of the platform 2 shown in FIG. 5, with the back of the user 40 facing the elevated end 3. The user 40 can then sit down, much like sitting on a chair, and then lie back onto the inclined surface previously established for the platform 2. The arms 41 of the user 40 are placed around the supports 15 so the arm pits 42 are engaged by the bodies 23. The hands 43 of the user 40 can engage the hand grips 25 and the forearms 44 of the user 40 can rest on the arm rests 24, in whatever position is most comfortable for the user 40. This is facilitated by available movements of the supports 15 in the various directions shown by the arrows 36, 37, 38 illustrated in FIG. 2. Padding associated with the platform 2 and the bodies 23 can provide added comfort for the user 40 while lying on the apparatus.

After assuming a comfortable position on the platform 2, the user 40 can relax the body and allow gravity to stretch the back responsive to the weight of the user 40, and the incline of the platform 2, which can be adjusted as needed. Heating pads associated with the apparatus can then be used to apply heat to different portions of the user's body, such as the upper body, the lower back, or the arms of the user 40. The user 40 can remain on the apparatus for whatever duration is indicated or desired.

To dismount the apparatus, following its use, the above-described steps can be reversed. For example, the user 40 can rise to a seated position and lower the user's legs to each side of the apparatus, or the user 40 can assume some other position suited to the user's abilities. The user 40 can then stand upright and step away from the apparatus.

The apparatus can then be stored, if desired, by breaking down a portable embodiment. The supports 15 can be removed from the platform 2, and stored in this configuration, or further broken down by removing the brackets 19 from the recesses 26 of the bodies 23. If desired, the underside of the platform 2 can be provided with storage hardware, sockets or compartments for receiving the supports 15 following disassembly. The supports 5, 6 can be folded by releasing the struts 14, so the supports 5, 6 can rotate about the pivots 13, allowing the supports 5, 6 to be lowered, preferably to a position adjacent to the platform 2. For an apparatus having a segmented platform 2, hinged segmented portions can be folded to a closed position and engageable structures for joining separable segmented portions can be disassembled, as appropriate. If desired, the components of a portable embodiment of the apparatus can be broken down in a manner which retains the adjustments which have previously been described.

Figure 7:
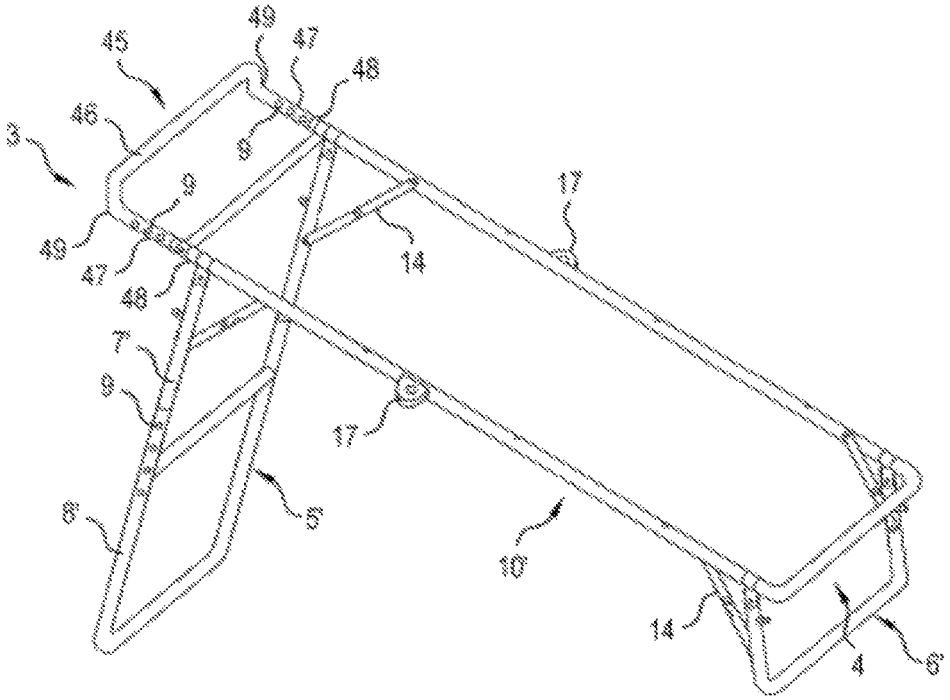
FIG. 7 is an isometric view of an alternative embodiment frame produced in accordance with the present invention and including a hand grip.

FIG. 7 shows an alternative embodiment frame 10' which can be combined with a supporting surface 11 attached to and extending over the frame 10' to form the platform 2, as previously described. The frame 10' is substantially similar to the frame 10 shown in FIGS. 1 and 2, in its overall configuration and in its manner of use. However, the frame 10' in FIG. 7 uses tubular structures to form the various components of the frame 10' and the supports 5', 6' associated with the frame 10'. In addition, and as previously described, the supports 5' are formed as a pair of telescoping members 7', 8', one of which has a series of apertures 9 for accepting appropriate hardware for suitably engaging the other, to allow the lengths of the supports 5', and as a consequence, the elevation of the end 3 of the platform 2, to be adjusted by variation of the engaged apertures 9.

FIG. 7 also shows a grab bar 45 associated with the end 3 of the frame 10', which generally includes a grip 46 and elongate members 47 associated with opposing ends of the grip 46, for engaging tubular elements 48 of the frame 10'. The elongate members 47 preferably include a series of apertures 9 which can accept appropriate hardware, for example, the previously described spring-biased detent arrangements, for suitably joining the members 47, 48 so that by selecting the apertures 9 used to join the members 47, 48, extension of the grab bar 45 can be adjusted to suit a particular user. As an alternative, the members 47, 48 can each be provided with a series of apertures 9 for receiving appropriate hardware for suitably joining the members 47, 48, for example, using wing nuts, bolts or threaded components. Variation of the apertures 9 used to join the members 47, 48 can then operate to adjust extension of the grab bar 45. The shape of the grab bar 45 can be varied, as preferred, to maximize convenience when in use. For example, the ends of the elongate members 47 shown in FIG. 7 are preferably curved, at 49, causing the grip 46 to extend upwardly from the frame 10' to facilitate grasping of the bar 46. Other configurations and placements for the various structures of the grab bar 45 are equally possible to suite a particular application or a user's abilities.

Figure 8:
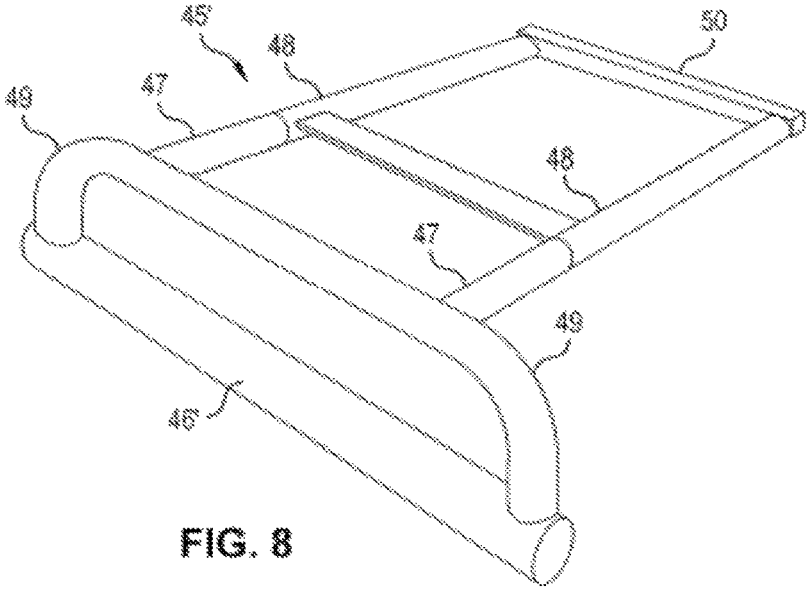
FIG. 8 is a perspective view of an alternative embodiment hand grip for use with the apparatus shown in FIGS. 1 and 2.

FIG. 8 shows a grab bar 45' which is suitable for use with the supporting surface 11, or an apparatus having a frame 10 of the type shown in other embodiments. The grab bar 45' is substantially similar to the grab bar 45 shown in FIG. 7, in its overall configuration and in its manner of use. However, the grab bar 45' includes a grip 46' having a different configuration, and the elongate members 47 are coupled with tubular elements 48 of a frame 50 for use in attaching the grab bar 45' to the supporting surface 11 or the frame 10 of the apparatus using suitable hardware.

Figure 9:
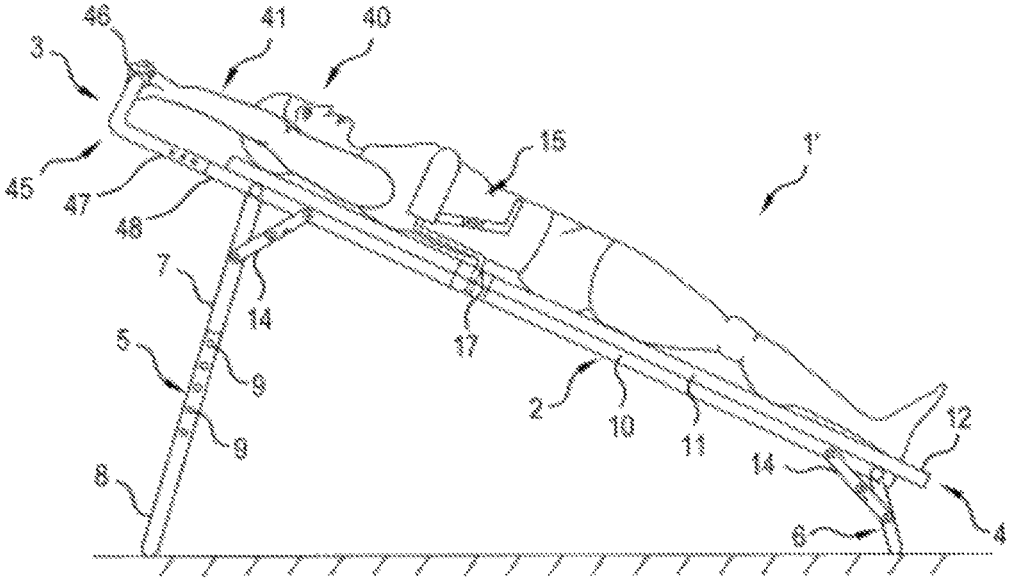
FIG. 9 is a side elevational view similar to FIG. 5, showing a user positioned on the apparatus and using the grab bar shown in FIG. 7.
Figure 10:
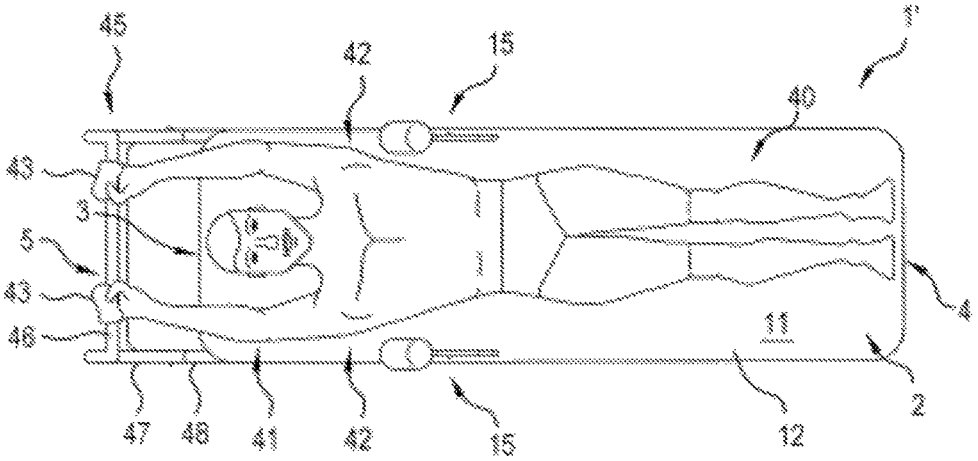
FIG. 10 is a top plan view similar to FIG. 6, also showing use of the grab bar shown in FIG. 7.

FIGS. 9 and 10 show use of the grab bar 45 with the apparatus 1' shown in FIGS. 5 and 6. For portable embodiments, the apparatus must first be deployed, as previously described. Following this or for fixed embodiments of the apparatus, and as part of the set-up procedure, the grab bar 45 (or 45') can be adjusted to suitably accommodate the user. To this end, extension of the grip 46 beyond the end 3 of the platform 2 can be adjusted by selection of the apertures 9 used to join the elongate members 47 and the tubular elements 48, as previously described. Supports 15 will again be coupled with the platform 2 by mating the rods 21 of the brackets 19 with the apertures 17 associated with the frame 10' and by mating the rods 22 of the brackets 19 with the recesses 26 of the bodies 23, permitting compound rotational movement of the supports 15 in the direction of the arrows 36, 37, 38 shown in FIG. 2.

A user 40 can then mount the platform 2 and lie back onto the inclined surface of the platform 2, while the arms 41 of the user 40 are placed around the supports 15 so the arm pits 42 are engaged by the bodies 23, as previously described. The hands 43 of the user 40 can engage the hand grips 25 and the forearms 44 of the user 40 can rest on the arm rests 24, in whatever position is most comfortable for the user 40.

After assuming a comfortable position on the platform 2, the user 40 can reach back and engage the grip 46 of the grab bar 45 while relaxing the body and allowing gravity to stretch the back responsive to the weight of the user 40, and the incline of the platform 2. The user 40 can remain on the apparatus for whatever duration is indicated or desired. While engagement of the grab bar 45 with the hands of the user is presently considered preferred for most applications, it is also possible for the user to engage the grab bar 45 with the feet, in situations where inversion of the user is desired.

To dismount the apparatus, following its use, the above-described steps can be reversed. The apparatus can then be stored, if desired, by the suitable break-down of a portable embodiment of the apparatus, as previously described. If desired, the supports 15 can also be stored, as previously described.

As a result of the foregoing, a user can accomplish spinal decompression without the need for straps or trussing. This can be accomplished conveniently, as well as comfortably, due to cushioned support provided for the user's upper body, to passively decompress the user's spine. The grips and pivoting structures associated with the supports 15, and the grip 46 associated with the grab bar 45, if used, allow the user to adjust position for comfort and proper attitude, and a wide range of body types can be accommodated.

The resulting apparatus is affordable for home use, and is easy to use, mount and dismount, even while experiencing pain. No strapping or trussing is required, and the user can finely and passively control the amount of stretching being applied. The need to use active devices such as springs or motors, which could be deleterious and difficult to control, is eliminated. The apparatus is easy to set up and store, and can be made foldable for storage or transport, if desired. The apparatus can be used with or without the application of heat, as is preferred for a particular use.

It will be understood that while the present invention has been described based on specific embodiments incorporating specified parts, the present invention further encompasses all enabled equivalents of the parts described, and that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for performing spinal decompression, comprising:

a surface for receiving a user, the surface being inclined at an angle, obtuse to a vertical position, the surface having a pair of opposing, parallel sides, each of the pair of opposing, parallel sides having an aperture formed therein;

a support for each of the parallel sides, each support comprising:

a rod having a first end insertable into the aperture and a second end;

the second end inserted into a body; and an armrest extending outwardly from the body.

2. The apparatus according to claim 1, wherein the first end of the rod is generally parallel to the second end of the rod.

3. The apparatus according to claim 1, wherein the body comprises a bearing adapted to receive the second end of the rod.

4. The apparatus according to claim 1, wherein the armrest extends from a lower end of the body.

5. The apparatus according to claim 1, wherein the armrest is extendable from the body.

6. The apparatus according to claim 1, wherein the first end of the rod has a spring-loaded, mating engagement with the aperture.

7. The apparatus according to claim 1, wherein the second end of the rod has a spring-loaded, mating engagement with the body.

8. The apparatus according to claim 1, wherein the armrest extends an angle oblique to the body.

9. The apparatus according claim 1, wherein the armrest further comprises a handgrip extending generally parallel to the second end of the rod.

10. An apparatus for performing spinal decompression, comprising:

a surface extending obliquely to a horizontal position, the surface having opposing longitudinal sides;

a pair of opposing arm supports, each of the pair of opposing arm supports rotationally extending from one of the opposing longitudinal sides;

a body attached to each arm support, and wherein each arm support comprises:

a first vertical end insertable into the aperture;

a second vertical end insertable into the body; and an arm extending between the first vertical end and the second vertical end, wherein each of the pair of opposing arm supports are spring-loaded to rotate, wherein each longitudinal side has an aperture, and wherein one of the arm supports is removably insertable into each aperture, and wherein each of the first vertical end and the second vertical end extends normal to the surface.

11. The apparatus according to claim 10, further comprising an armrest extending outwardly from the body.

12. The apparatus according to claim 11, wherein the armrest is extendible from the body.

13. The apparatus according to claim 10, wherein each of the pair of opposing arm supports has a spring-loaded, mating engagement with a respective longitudinal side.

14. The apparatus according to claim 10, wherein the armrest extends at an adjustable angle relative to the body.

15. The apparatus according to claim 10 wherein the body is removably attached to the second vertical end.

16. The apparatus according to claim 10, wherein the arm extends parallel to the surface.

* * * * *